United States Patent [19]

Fraizer

[11] Patent Number: 5,010,458

[45] Date of Patent: Apr. 23, 1991

[54] HEADLAMP ASSEMBLY

[75] Inventor: Robert L. Fraizer, Kokomo, Ind.

[73] Assignee: General Motors Corporation, Detroit, Mich.

[21] Appl. No.: 401,891

[22] Filed: Sep. 1, 1989

[51] Int. Cl.[5] ..... F21M 3/02

[52] U.S. Cl. ..... 362/80; 362/341; 362/351

[58] Field of Search ..... 362/61, 80, 296, 310, 362/341, 351

[56] References Cited

U.S. PATENT DOCUMENTS

| | | | |
|---|---|---|---|
| 4,446,511 | 5/1984 | Sands | 362/61 |
| 4,520,432 | 5/1985 | Mayer et al. | 362/61 |
| 4,586,116 | 4/1986 | Kasboske | 362/61 |
| 4,807,094 | 2/1989 | Mateos et al. | 362/290 |
| 4,851,810 | 7/1989 | Vitale et al. | 362/61 |
| 4,855,877 | 8/1989 | Otaka | 362/61 |

*Primary Examiner*—Ira S. Lazarus
*Assistant Examiner*—Richard R. Cole
*Attorney, Agent, or Firm*—Edward J. Biskup

[57] ABSTRACT

A headlamp assembly in which various parts of the interior reflector are coated with a material of a desired color so that a clear lens covering the reflector will give the appearance of being the same color as the interior of the headlamp.

9 Claims, 3 Drawing Sheets

HEADLAMP ASSEMBLY

This invention concerns headlamps in general and more particularly relates to headlamp assemblies which when not lighted has the colorless lens thereof appear to be the same color as the adjacent panels of the front of a vehicle.

U.S. Pat. No. 4,807,094 issued on Feb. 21, 1989 entitled Headlamp Assembly, and in the name of Mateos et al, and assigned to the assignee of the present invention concerns a headlamp system having the headlamp located within the vehicle in a position so that the outer surface of the lens is flush with the adjacent panel portions, such as the hood and fenders and other panel portions surrounding the headlamp, and having colored louvers located within the lamp which are coated with a paint or the like of the same color as the adjacent panel portions of the vehicle. By providing a sufficient number of the louvers within the lamp, it has been found that the crystal or colorless lens of the headlamp takes on hue of the coated louvers and causes the headlamp to, in effect, appear to be the same color as the adjacent panels. Thus, when the headlamp is installed on the vehicle, it is perceived as having a cover that conceals the headlamp.

The present invention concerns a vehicle headlamp which is similar to that described above in that the colorless lens will appear to be colored with the result being attained by having various parts of the interior of the headlamp coated with a material having the desired color. More specifically, in one form of the headlamp assembly according to the present invention, the headlamp assembly includes a rectangular housing closed by a colorless lens and formed with a cavity therein defined by a flat lower wall, a flat upper wall and a parabolic reflector portion. In the preferred form of the invention, a shield surrounds the light source and has the outer surface thereof coated with a material having a desired color. In addition, the inner surface of both the upper wall and the lower wall are coated with a material the color of which is the same as the desired color. The arrangement is such that during the daytime, when the headlamp is not illuminated, the colored light shield is reflected by the parabolic reflector and together with the colored walls causes the colorless lens to appear to be the same color as the walls and the shield.

In a second form of the present invention, the headlamp assembly has the bulb shield and the walls of the reflector housing coated as explained above and, in addition, the aluminum film on the parabolic portion of the reflector is provided with a protective top coat over the aluminum film. That is tinted the same color as the color of the bulb shield and the walls of the reflector. In a third form of the present invention, both of the aforementioned walls and the parabolic portion of the reflector are also coated as explained above, however, the use of a coated bulb shield is not necessary. Instead, the parabolic portion of the reflector is first treated with a basecoat having the color desired for the headlamp. The reflector portion is then aluminized with a semi-transparent coating of the aluminum so as to cause the basecoat to be visible without detracting from the ability of the reflector to provide a white light when illuminated. In other words, the aluminum is deposited on the parabolic portion of the reflector thin enough to be slightly transparent causing the color of the base coat to be visible so that, in conjunction with the colored inner surfaces of the upper and lower walls, the lens appears to be the same color as the basecoat and the walls.

The objects of the present invention are to provide a new and improved headlamp assembly of a rectangular configuration having a clear lens and flat upper and lower walls the inner surfaces of which are provided with a material having a desired color and a bulb shield coated with a material of the same color with the bulb shield being located at the focal point of the reflector so as to cause the reflector to reflect the color of the bulb shield and, together with the color emitted by the upper and lower walls, results in the lens appearing to the observer to be of the same color as the shield and the walls; to provide a new and improved headlamp assembly in which various parts of the interior of the reflector are coated with a material of a desired color so that a clear lens covering the reflector will give the appearance of being the same color as the color of the interior parts of the headlamp; to provide a new and improved headlamp assembly in which discrete parts of the reflector housing are coated with a material having a desired color and the metallic reflector film of the parabolic reflector has a top coat thereon which is tinted with the same color so as to cause the colorless lens to appear to be colored; and to provide a new and improved headlamp assembly in which the parabolic reflector is provided with a base coat of a particular color and afterwards is aluminized so as to cause the parabolic portion of the reflector to be semi-reflective and allow some of the color of the base coat to be visible without effecting the ability of the headlamp to provide a white light when illuminated.

Other objects and advantages of the present invention will be more apparent from the following detailed description when taken with the drawings in which FIG. 1 is an exploded perspective view of a headlamp assembly made in accordance with one embodiment of the present invention;

Figure 1:
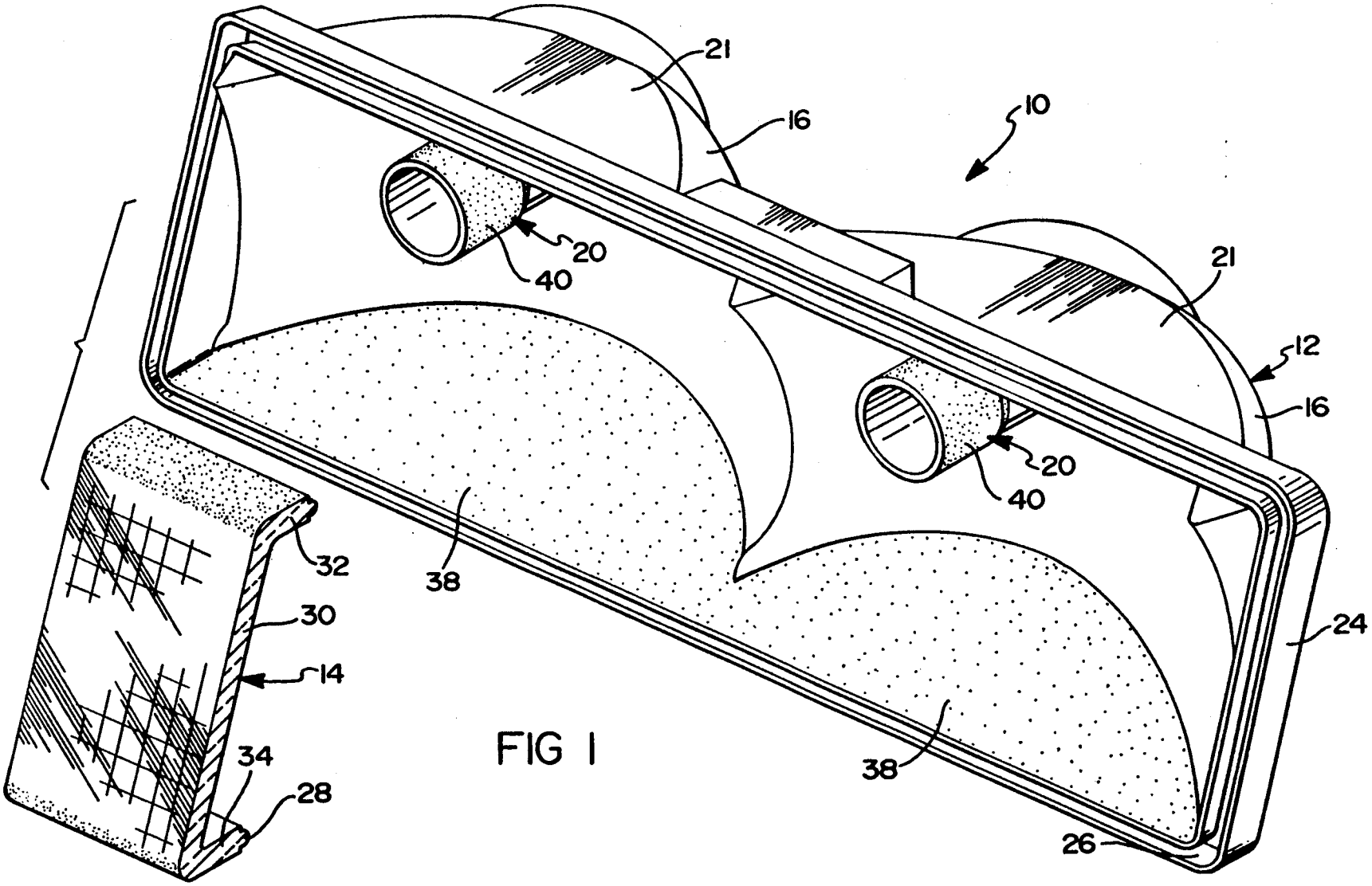
Figure 2:
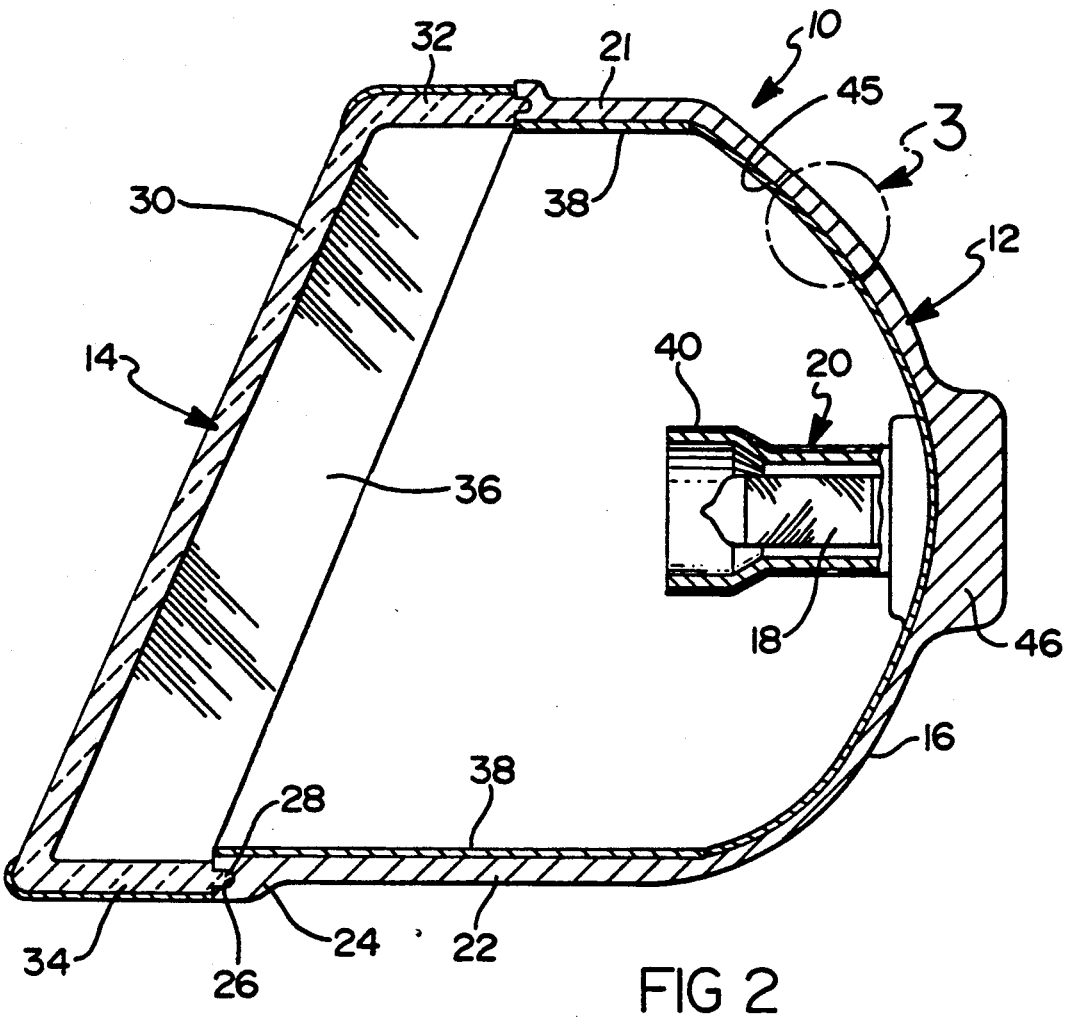
FIG. 2 is a sectional view of the headlamp assembly seen in FIG. 1.

Referring now to the drawings and more particularly FIGS. 1 and 2 thereof, a generally rectangular headlamp assembly 10 is shown which includes a plastic reflector member 12 the open end of which is adapted to be closed by a crystal or colorless clear lens 14. The reflector member 12 is formed with a pair of side-by-side cavities each of which includes a parabolic reflector portion 16 which is aluminized so as to provide a reflecting surface which will project a light beam forwardly and substantially parallel to the optical axis of the associated parabolic reflector portion. Each of the cavities is provided with a single filament replaceable light bulb 18, as seen in FIG. 2, which according to one embodiment of the present invention, is surrounded by a tubular light bulb shield 20 having a major portion thereof located at the focal point of the associated parabolic reflector portion. In addition, together with the parabolic reflector portion 16, each cavity is defined by a lower flat wall 22 and an upper flat wall 21 which lie in parallel planes. As aforementioned the two cavities of the reflector member 12 are located side-by-side and, as best seen in FIG. 1, the cavities are bounded by a suitably thickened rectangular portion 24 having a continuous rectangular groove or channel 26 which receives the rear marginal portion 28 of the lens 14. An adhesive or sealant such as butyl rubber, may be provided in the channel 26 to prevent the ingress of foreign material. As seen in FIG. 2, the lens 14 is generally U-shaped in cross-section and includes an inclined front portion 30 integrally formed with the rearwardly extending and parallel upper section 32 and a lower section 34 and a pair of laterally spaced side sections one of which only is shown and identified by the referenced numeral 36. Although not shown, the inner face of the front portion 30 can be provided with optical flutes which serve to direct the light beams in a prescribed pattern.

As aforementioned, the headlamp assembly 10 according to the invention when installed in the front end of a motor vehicle and when unlighted causes the colorless or crystal lens 14 to appear to be the same color as the adjacent panels of the vehicle. Thus, the lens 14, in effect, conceals the headlamp assembly 10 without requiring the high cost of utilizing retraction mechanisms frequently provided on motor vehicles. This is accomplished by having the entire inner surfaces of both the upper wall 21 and lower wall 22 of each reflector cavity coated with a paint 38 of a desired color as seen in FIGS. 1 and 2. In addition, the entire peripheral outer surface of each of the light bulb shields 20 will similarly be coated with a heat resistant paint 40 or the like of the same color. One method of providing the desired color on each light bulb shield 20 would be to have the light bulb shield 20 made from stainless steel and afterwards powder coat the shield 20 with a ceramic colored material or the like. One requirement is that the material coating the light bulb shield 20 withstand temperatures of about 275° F. As to providing the desired color on the upper and lower walls 21 and 22 of the reflector cavities, rather than coating the walls 21 and 22, a die cut insert with the desired color can be adhesively or mechanically attached to the walls 21 and 22. As should be apparent, the temperature inside the headlamp when illuminated is an important factor in selecting the material, and therefore the material chosen must be one which will withstand the high temperatures attained in an illuminated headlamp.

Figure 3:
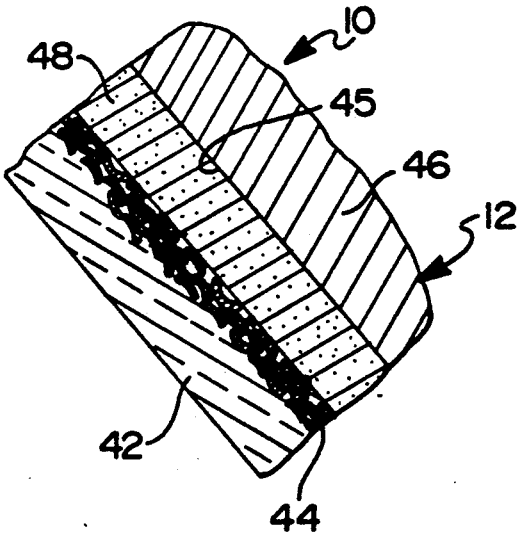
FIG. 3 is an enlarged view of the circle areas seen in FIG. 2.

The colored coating 38 applied to both the upper and lower walls 21 and 22 and to the light bulb shield 20 will serve to cause the clear lens 14 to be perceived by an observer as being of the same color as the walls 21 and 22 and light bulb shield 38. However, to further enhance the viewer's perception of the desired color, the aluminized inner surface of the parabolic reflector portion 16, which is normally coated with a clear protective top coat, can also be colored. In other words, the top coat would be tinted with the desired color and either sprayed or dip coated over the aluminized film. This addition of color to the top coat will not effect the lighting provided by the headlamp so long as the concentration of tint pigment is low. One example of a tinted top coat 42 over an aluminized film 44 can be seen in FIG. 3. In this instance, the inner parabolic surface 45 of the polyester reflector structure 46 is provided with a UV cured clear basecoat 48 identified as UVB9R6 which is completely manufactured by Red Spot Paint and Varnish Co., 110 Main, Evansville, Ind. 47703. Afterwards, the basecoat 48 is covered with the aluminum film 44 which, in this case, is approximately 1,000 Angstroms. The top coat 42 such as SM1636-R4 baked 20 minutes at 180° F. and made by the Red Spot Paint and Varnish Co., in turn, covers the aluminum film 44 and such top coat would be tinted with a pigment of the desired color in a five to ten percent concentration. Thus, when the upper and lower walls 21 and 22, the light bulb shield 18, and the tinted top coat 42 are utilized together, the perceived color of the lens 14 will be darkened.

Figure 4:
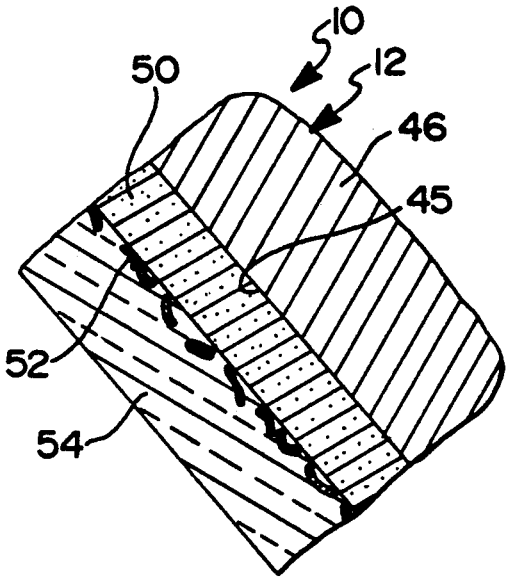
FIG. 4 is an enlarged view of a modified form of the circled area seen in FIG. 2.

Another method of increasing the perceived colorization of the lens 14 is to maintain the colored upper and lower walls 21 and 22 as described above, and to provide the coatings on the inner surface 45 of the raw thermosel polyester parabolic reflector portion 16 as seen in FIG. 4. In this instance, the basecoat will have pigment added thereto so that the basecoat 50 has the desired color. A basecoat made by the Red Spot Paint and Varnish Co. to which a pigment can be added is identified as EB33R1 which would be baked onto the surface 45 for one hour at 250° F. Afterwards, the basecoat 50 would be semi-aluminized at less than 1000 Angstroms at which point the metallic material becomes opaque and preferably in a range 400 to 800 Angstroms so that some of the color of the basecoat 50 can be seen while allowing the light rays emitted by the light bulb 18 to be reflected off the semi-aluminum film 52 with no shift in the light bulb's spectral color. The aluminum film 52 would then be provided with a clear topcoat 54, such as ultra violet cured UVT53R6 also made by the Red Spot Paint and Varnish Co., to protect the semi-aluminized film 52.

Figure 5:
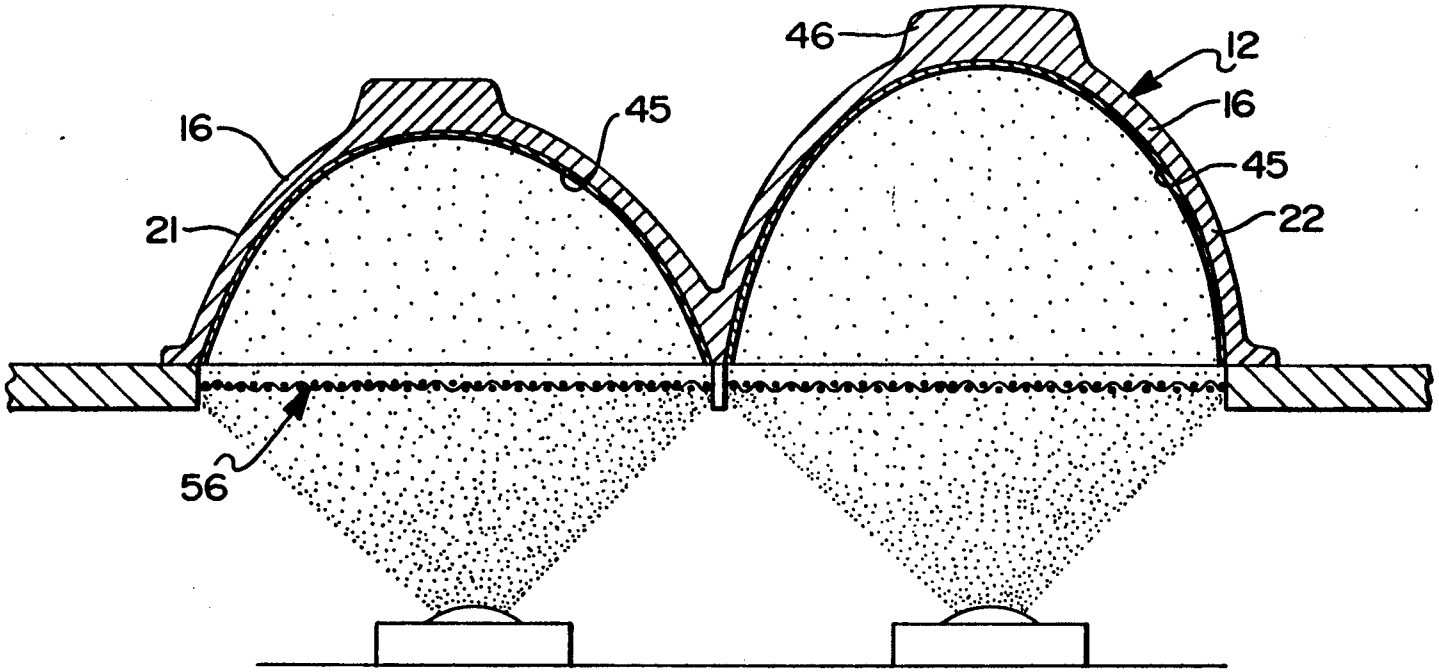
FIG. 5 is an elevational view of a headlamp reflector having its parabolic reflector portions being coated with a reflective material.
Figure 6:
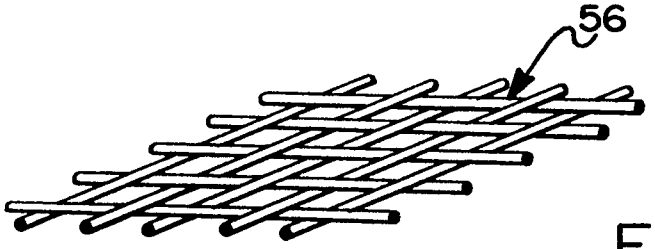
FIG. 6 is an enlarged view of a mesh which can be used in the coating process seen in FIG. 5 for obtaining a thin reflective coating on the parabolic reflector portions.

FIG. 5 shows the reflector member 12 having the basecoat 50 on the inner surfaces 45 of the parabolic reflection portions 16 being aluminized by a vacuum metalizing process. The aluminized film would be provided over the colored basecoat as seen in FIG. 4, and by using a mesh or screen 56 as seen in FIG. 6, with openings of a predetermined size, the atomized aluminum can be deposited over the basecoat 50 in an amount which would make it slightly transparent allowing the color of the base coat 50 to be visible. One advantage of having a colored basecoat 50 with a semi-aluminized coating as described above is that only white light will be reflected by the aluminum film 52 when the headlamp is illuminated, and when not illuminated, the color of the basecoat 50 serves to cause the lens 14 to appear to be of the same color. Of course, depending upon the amount of color which one desires to have the lens 14 perceived as having, will determine whether the colored bulb shield 20 and the colored walls 21 and 22 will be used together with the colored basecoat 50. In addition, if desired and as seen in FIGS. 1 and 2 the outer surfaces of the upper and lower sections 32 and 34 as well as the outer surfaces of the side sections 36 of the lens 14 can be coated with the same color to further enhance the perceived color of the lens 14 in any of the embodiments of the invention described above.

It should be noted that when practicing the invention, the photometric and color of transmitted light requirements for headlamps as established by the governmental agency having jurisdiction over the area where the headlamp 10 is used must be taken into consideration. In this regard, in certain tests conducted on a Chevrolet L model reflector housing identified by General Motors Corporation as part number 16505529, it was found that all reflectors and shields colored as set forth below passed SAE standard J578C for headlamp specification for white light.

1. Coupe LH housing—Dark red colored basecoat and shield—aluminum film (500–800 Angstroms).
2. Sedan LH housing—Dark red colored basecoat and shield—aluminum film (300–600) Angstroms).
3. Coupe LH housing—Colored topcoat (Light Red tint)—dark red colored shield—aluminum film (above 1000 Angstroms).
4. Coupe LH housing—Red colored topcoat (Medium Red tint)—dark red colored shield—aluminum film (above 1000 Angstroms).

Various changes and modifications can be made in the above described invention without departing from the spirit of the invention. Such changes and modifications are contemplated by the inventor and, accordingly, he does not wish to be limited except by the scope of the appended claims.

The embodiments of the invention in which an exclusive property or privilege is claimed are defined as follows:

1. A method of causing the clear lens of a vehicle headlamp to appear to an observer to be of a particular color when not lighted by the headlamp light source to provide a desired amount of light, said method comprising the steps of providing a rectangular headlamp housing having a cavity defined by a pair of planar and parallel upper and lower walls each having an inner surface and joined to a parabolic reflector portion having an inner surface, coating the inner surface of said parabolic reflector portion with a base coat having a desired color, and applying a semi-transparent metallic film over said basecoat so as to allow the color of said basecoat to be seen without preventing the desired amount of light emitted by said light source from being reflected by said parabolic reflector portion through said lens.

2. The method of claim 1 wherein the inner surfaces of said upper and lower walls are coated with a material of the same color as said desired color.

3. The method of claim 1 wherein the metallic film has a thickness less than 1000 Angstroms.

4. The method of claim 1 wherein the metallic film has a thickness in the range 400–800 Angstroms.

5. A headlamp assembly adapted to be mounted in an opening in a motor vehicle, said headlamp assembly including a housing closed by a clear colorless lens, said headlamp assembly including a housing having a parabolic reflector portion provided with a concave inner surface and a focal point a light source located at the focal point of said parabolic reflector portion for providing a desired amount of light, the concave inner surface of said parabolic reflector portion being coated with a basecoat of a particular color, a reflective metallic coating having a thickness in the range of 400–800 Angstroms covering said basecoat so as to allow the color of said basecoat to be seen without preventing the desired amount of light from being reflected by said parabolic reflector portion through said lens.

6. A headlamp assembly adapted to be mounted in an opening in a motor vehicle defined by the outer panel portions of said motor vehicle, said headlamp assembly including a housing closed by a colorless lens, said housing being generally rectangular in configuration and having a cavity therein defined by a flat lower wall, a flat upper wall and a parabolic reflector, said upper wall and said lower wall each having an inner surface, a source of light carried by said parabolic reflector, a shield having an outer surface surrounding said light source, the outer surface of said shield being coated with a material having a particular color, and the inner surfaces of said lower wall and of said upper wall being coated with a material having a color which is the same as the color of said outer surface of said shield so when said light source is not illuminated the parabolic reflector reflects the color of said shield and together with the color of the inner surfaces of said lower and upper walls causes said len to appear to the observer to be the same color as said panel portion.

7. The headlamp assembly of claim 6 wherein said parabolic reflector is coated with a basecoat of the same color as the color of said shield and said upper and lower walls, and said basecoat is covered by a semi-transparent metallic film for allowing the color of the basecoat to be seen without preventing adequate light emitted by said light source from being reflected by said parabolic reflector portion.

8. The headlamp assembly of claim 6 wherein said lens includes rearwardly extending upper and lower sections and a pair of laterally spaced side sections each having an outer surface, and the outer surface of each of said sections being coated with an material of the same color as said particular color.

9. A headlamp assembly adapted to be mounted in an opening in a motor vehicle defined by the outer panel portions of said motor vehicle, said headlamp assembly including a housing closed by a colorless lens, said housing being generally rectangular in configuration and having a cavity therein defined by a flat lower wall, a flat upper wall and a parabolic reflector, said lower wall and said upper wall each having an inner surface, a source of light carried by said parabolic reflector, said parabolic reflector having a metallic film thereon for reflecting the light rays emitted by said light source, a shield surrounding said light source and having an outer surface, the outer surface of said shield being coated with a material having a particular color, a transparent coat of material covering said metallic film on said parabolic reflector that is tinted with the same color as said particular color, and the inner surfaces of said lower wall and of said upper wall being coated with a material having a color which is the same as the color of said outer surface of said shield so when said light source is not illuminated the parabolic reflector reflects the color of said shield and together with the color of the inner surfaces of said lower and upper walls and said tinted top coat causes said len to appear to the observer to be the same color as said panel portion.

* * * * *